US005816167A

United States Patent [19]

Danforth et al.

[11] Patent Number: 5,816,167

[45] Date of Patent: Oct. 6, 1998

[54] PLAYGROUND CARRIAGE

[75] Inventors: Paul Danforth, Federal Way; Daniel York, Tacoma, both of Wash.; Russell Keeler, Baltimore, Md.; John Underbrink, Richardson, Tex.

[73] Assignee: Kompan, Inc., Olympia, Wash.

[21] Appl. No.: 702,655

[22] PCT Filed: Mar. 10, 1995

[86] PCT No.: PCT/US95/03100

§ 371 Date: Feb. 13, 1997

§ 102(e) Date: Feb. 13, 1997

[87] PCT Pub. No.: WO95/24248

PCT Pub. Date: Sep. 14, 1995

(Under 37 CFR 1.47)

Related U.S. Application Data

[63] Continuation-in-part of Ser. No. 209,952, Mar. 11, 1994, Pat. No. 5,443,012.

[51] Int. Cl.[6] ..... A63G 1/00

[52] U.S. Cl. ..... 104/53; 104/166; 104/118; 105/141; 105/148; 188/43

[58] Field of Search ..... 104/53, 56, 57, 104/89, 93, 126, 166, 167, 118, 242, 243, 245, 249, 252, 260, 163; 198/321; 105/141, 148, 149.1, 150; 188/33, 43, 35, 41, 49

[56] References Cited

U.S. PATENT DOCUMENTS

| | | | |
|---|---|---|---|
| 188,611 | 3/1877 | Dutrow . | |
| 402,933 | 5/1889 | Judson . | |
| 2,241,399 | 5/1941 | Harris . | |
| 3,057,305 | 10/1962 | Behrens . | |
| 3,164,104 | 1/1965 | Hunt . | |
| 3,604,362 | 9/1971 | Goirand . | |
| 3,850,280 | 11/1974 | Ohrnell . | |
| 3,897,735 | 8/1975 | Watts . | |
| 3,969,871 | 7/1976 | Ewers . | |
| 4,203,511 | 5/1980 | Uhing . | |
| 4,515,084 | 5/1985 | Jacoby | 104/118 |
| 4,603,720 | 8/1986 | Jacoby | 104/166 |
| 4,628,823 | 12/1986 | Mangan et al. | 104/166 |
| 5,154,275 | 10/1992 | Speckhart et al. . | |
| 5,156,507 | 10/1992 | Underbrink . | |
| 5,443,012 | 8/1995 | Underbrink et al. | 104/53 |

FOREIGN PATENT DOCUMENTS

| | | | |
|---|---|---|---|
| 714323 | 7/1965 | Canada . | |
| 4-41388 | 2/1992 | Japan . | |
| 4-266314 | 9/1992 | Japan | 104/166 |
| 1033823 | 6/1966 | United Kingdom . | |

*Primary Examiner*—Mark Tuan Le

*Attorney, Agent, or Firm*—Christensen O'Connor Johnson and Kindness PLLC

[57] ABSTRACT

In accordance with the present invention, a playground carriage (10) is provided for moving people (100) from one play area to another. The playground carriage comprises a rotatable support pipe (12) having a first end (14) and a second end (16). The support pipe extends between a first vertical column (18) and a second vertical column (20). A manually-operated crank extends between the first vertical column and a third vertical column (48). The first end of the crank is coupled to the first end of the support pipe so that manually turning the crank rotates the support pipe. A carriage (28) for carrying people is mounted to the support pipe. The carriage is advanced along the support pipe by a carrier assembly (102). The carrier assembly comprises a carrier (30) which propels the carriage and a brake (104) which is capable of bringing the carriage to a stop.

46 Claims, 8 Drawing Sheets

PLAYGROUND CARRIAGE

RELATED APPLICATIONS

This application is the National Stage of International Patent Application No. PCT/US95/031000 filed Mar. 10, 1995, published as WO95/24248 Sep. 14, 1995, which was a continuation-in-part of U.S. patent application Ser. No. 08/209,952, now U.S. Pat. No. 5,443,012, filed on Mar. 11, 1994.

FIELD OF THE INVENTION

This invention generally relates to playground and recreational equipment, and, more specifically, to a playground carriage used to move people along a path from one play area to another.

BACKGROUND OF THE INVENTION

Large, sturdy, and creative toys for use in playgrounds, parks, and similar recreational environments come in a multitude of shapes, sizes, and configurations. New and innovative playground toys and structures that safely entertain children and others are difficult to design. A play structure must be creative enough to capture a user's imagination (normally a child's imagination) and maintain his or her attention while still providing a high degree of safety. In addition, the play structure must withstand the rigors of the outdoors and constant use by children. Consequently, many playground structures are large, relatively stationary, wood and metal structures upon which children and others climb, swing and amuse themselves without serious threat of injury to themselves or damage to the structure. An example of such a play structure is a playground gym made of logs that includes fairly simple features such as a slides, tire ladders and swings. Playground equipment that involves more complex, interacting mechanical features, such as gears, wheels and carriages, are less common. Such play structures require a higher level of concerted human effort for operation. With the emphasis that the educational and health communities have recently placed on the need to promote physical fitness, communication and social interaction between persons at an early age, the demand for such innovative and complex playground equipment has increased. Accordingly, the present invention enables a person in a remote location to perform a physical function that inspires the users to communicate with each other more easily, to interact socially, and to exert themselves physically.

The present invention is a playground carriage that is designed to move people safely from one play area to another. A carriage loaded with people is propelled linearly along the length of a support pipe. The support pipe has a turning crank on at least one end that rotates the pipe as it is manually turned. The carriage is propelled along the rotating support pipe by a set of carriage wheels that are oriented at an angle to the face of the pipe so that they follow a helical or thread-like path along the pipe.

Devices for moving objects along a rotatable pipe that include an arrangement of wheels oriented at an angle to the surface of the pipe, such that rotating movement of the pipe is translated into longitudinal movement of the device, have already been disclosed in the prior art, e.g., U.S. Pat. No. 4,203,511. However, in the prior art these devices have been used only in conjunction with motorized cranking mechanisms. Motorized or electro-mechanical cranking mechanisms are not practical in a playground or recreational environment from the standpoints of both safety and cost. On the other hand, manual cranking mechanisms as employed by the present invention are safer and more cost efficient. More importantly, the manual cranking mechanism of the present invention requires human effort for operation, as well as encouraging communication, social interaction and physical exertion among the users.

Finally, the devices disclosed in the prior art must be made inaccessible to persons in a playground or recreational environment in order to prevent injury. Such protective measures are not contemplated in the prior art. In the present invention, however, the carriage wheels are covered by a protective housing so that they are inaccessible to users.

In sum, the present invention provides a creative, exciting, yet safe, play structure for transporting people, wherein a person must manually turn a crank to propel a carriage carrying others from one play area to another. The present invention requires that the users cooperate in order to successfully propel themselves along the pipe. Thus, the present invention promotes communication, social interaction and physical exercise.

SUMMARY OF THE INVENTION

The present invention provides an apparatus for use in playground and recreational environments that is adapted to move from one area to another. The present invention includes a support pipe rotatable along its longitudinal axis, a first end of the support pipe braced by a first vertical column and a second end of the support pipe braced by a second vertical column, wherein the support pipe extends between the first vertical column and the second vertical column. A manually-operated crank having a first end and a second end is coupled to the first end of the support pipe so that manually turning the crank rotates the pipe. A carriage is mounted on the support pipe and is advanced along the support pipe as the support pipe is rotated by the crank.

The carriage comprises a carrier assembly including a carrier for propelling the carriage along the support pipe, and a brake capable of bringing the carriage to a stop. The brake is suspended from the carrier by a plurality of arms. The carrier contains a set of carrier wheels oriented along an outer surface of the pipe so that the set of carrier wheels follows a helical, thread-like path along the pipe and, thus, propels the carriage along the longitudinal axis of the pipe as the pipe is rotated. The brake is suspended beneath the support pipe and below the carrier. The brake includes a set of brake wheels oriented along the outer surface of the pipe such that the set of brake wheels follows the helical, thread-like path along the pipe when the brake is aligned with the carrier, but binds against the support pipe when the brake is not aligned with the carrier. In other embodiments of the present invention, the brake also includes an adjustable wiper that makes frictional contact with the support pipe when the brake is not aligned with the carrier.

In a preferred embodiment, a plurality of handrails extend downwardly from the carrier, and a platform is attached to the handrails so that the platform is suspended below the carrier. A protective housing encapsulates the carrier assembly.

A preferred embodiment of the present invention also comprises a guide rail adapted to guide the carriage. The guide rail is located immediately below the platform of the carriage and extends parallel to the support pipe between the first vertical column and the second vertical column. In addition, a guide attached to a lower surface of the platform engages the guide rail and prevents the carriage from swinging excessively as it moves along the pipe.

Other embodiments of the present invention include a receiving deck adjacent the second vertical column and upon which people transported by the carriage may dismount, and a cranking deck adjacent the first vertical column and upon which people manually turning the crank may be positioned.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
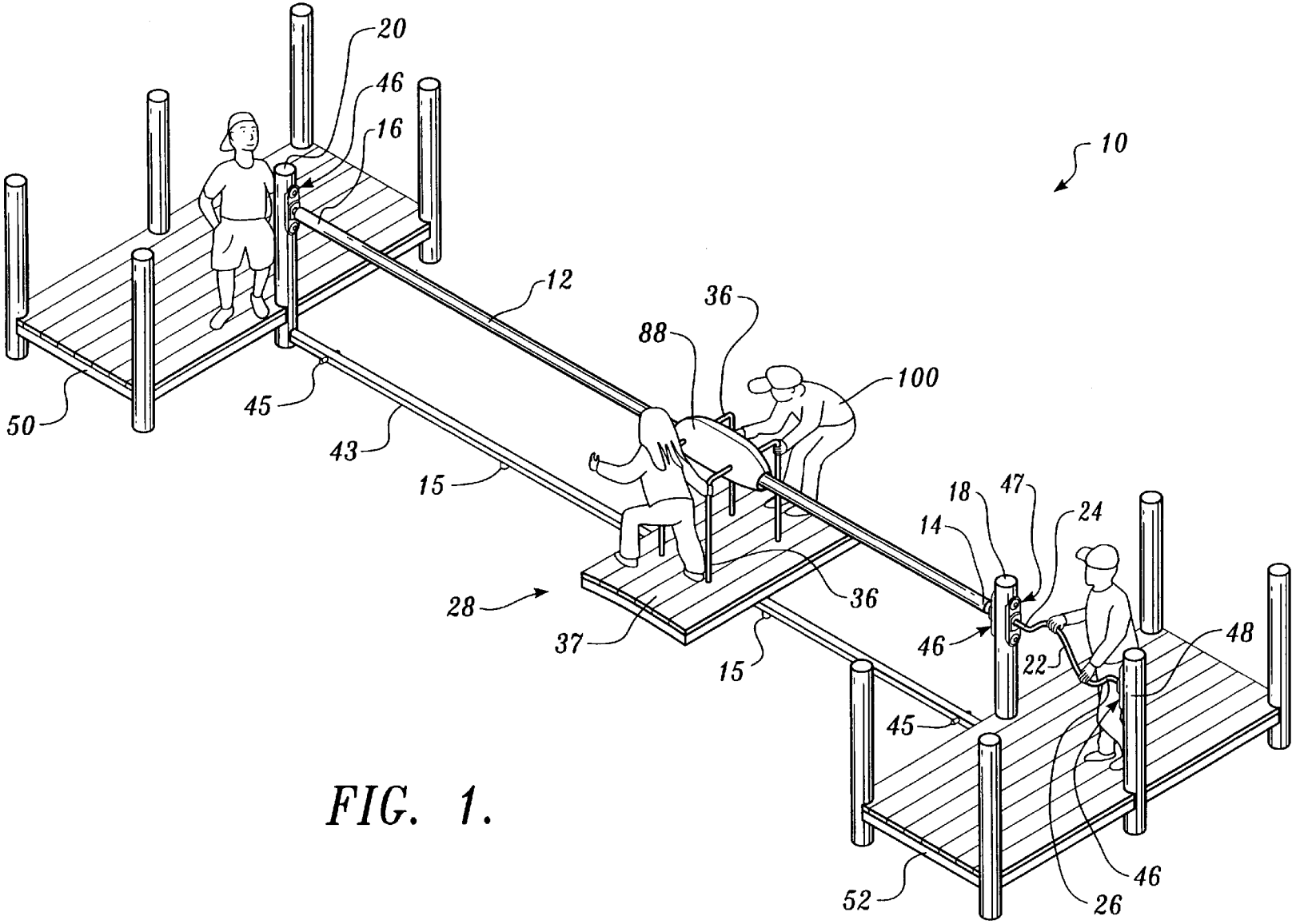
FIG. 1 is a three-dimensional view of a preferred embodiment of the present invention being used by a group of children on a playground.

A three-dimensional view of a preferred embodiment of the present invention is shown in FIG. 1. In the illustrated embodiment, a playground carriage 10 is shown being used by a group of people 100. The playground carriage 10 includes a support pipe 12 having a first end 14 and a second end 16. The pipe 12 extends between a first vertical column 18 and a second vertical column 20. A manually-operated crank 22 having a first end 24 and a second end 26 extends between the first vertical column 18 and a third vertical column 48. The first end 24 of the crank 22 is attached to the first end 14 of the pipe 12 so that the pipe is rotated about its longitudinal axis when a person manually turns the crank. In addition, the crank may be turned in one or the opposite direction. Therefore, the pipe is rotatable in one or the opposite direction as well.

Figure 2:
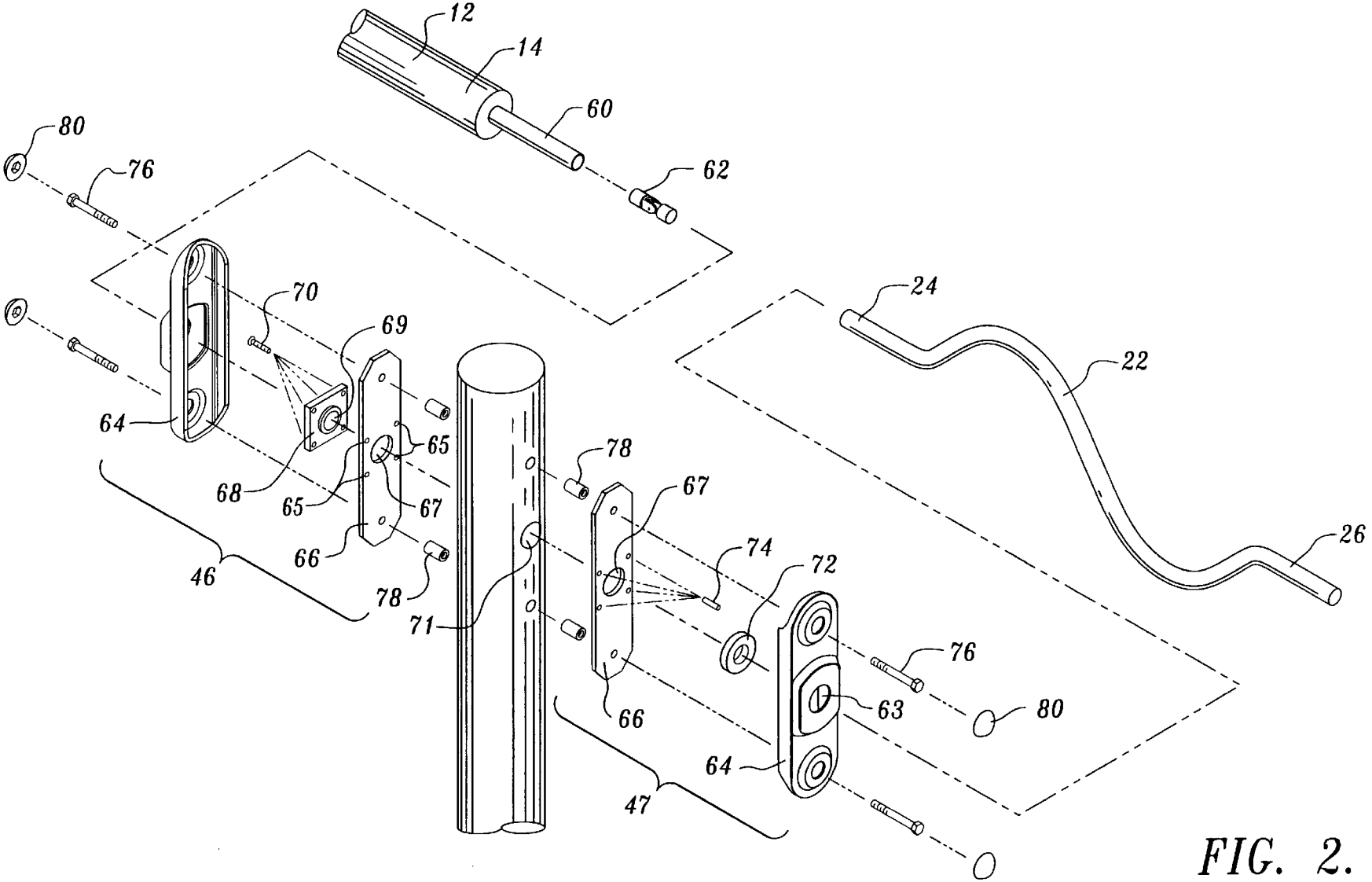
FIG. 2 is an exploded three-dimensional view of a crank, bearing, vertical column and support pipe assembly formed in accordance with the present invention.
Figure 3:
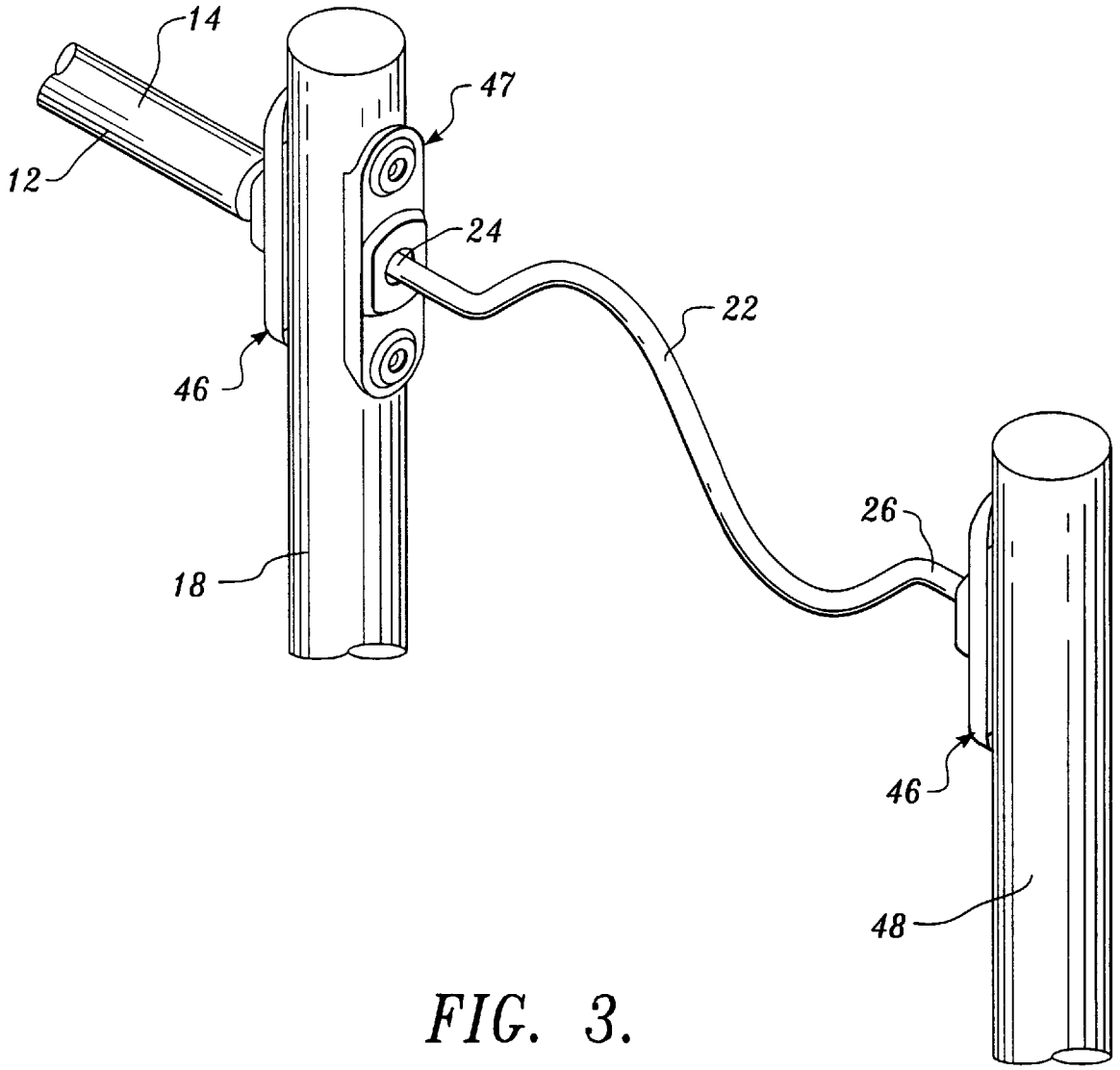
FIG. 3 is a three-dimensional view of the structure illustrated in FIG. 2 once assembled.

The playground carriage 10 is assembled so that the support pipe 12 and the manually-operated crank 22 are freely rotatable. As shown in more detail in FIGS. 2 and 3, the first end 14 of the pipe 12 is braced by a bearing assembly 46, which is mounted to one side of the first vertical column 18. The first end 24 of the crank is coupled to a ring assembly 47 mounted on the opposite side of the first vertical column. The ring assembly 47 is attached to the vertical column 18 and is centered around a bore 71 which has been drilled through the first vertical column. The ring assembly comprises a bearing plate 66, an O-shaped ring 72 and a bearing cover 64. First, the rectangular bearing plate 66 containing a bearing plate hole 67 is mounted to the first vertical column so that the bearing plate hole 67 is in alignment with the bore 71. The bearing plate also contains four small screw holes 65 which surround the bearing plate hole 67. A roll pin 74 is placed within each small screw hole 65 so that the roll pin protrudes beyond the surface of the bearing plate 66 and away from the first vertical column. The O-shaped ring 72 is then placed adjacent to the bearing plate and within an area defined between the protruding roll pins 74. Finally, the bearing cover 64 is mounted upon the first vertical column 18 so that it encases the bearing plate 66 and the O-shaped ring 72. A pair of bolts 76 attach the bearing plate and the bearing cover to the first vertical column. Each bolt 76 is secured to a nut 78 which is mounted in the first vertical column. A hemispherical cap 80 is mounted to the head of each bolt 76 to protect persons from scraping themselves against the bolt. The bearing cover is mounted upon the first vertical column so that a bearing cover hole 63 contained in the bearing cover is aligned with the O-shaped ring 72, the bearing plate hole 67, and the bore 71 drilled through the first vertical column. However, the bearing cover hole 63 is slightly larger in diameter than bearing plate hole 67. The O-shaped ring is preferably made of an ultra-high molecular weight plastic or similar anti-friction material, which allows the O-shaped ring to float relatively freely between the bearing cover and the bearing plate, and within the area defined by the roll pins 74. The floating O-shaped ring prevents persons reaching through the slightly larger bearing cover hole 63 and pinching themselves within the ring assembly.

The construction of the bearing assembly 46 bracing the first end 14 of the pipe 12 mirrors that of the ring assembly 47, except the bearing assembly is attached to the opposite side of first vertical column 18. In addition, the bearing assembly also contains the bearing plate 66 and the bearing cover 64. However, the bearing assembly contains a bearing 68 as opposed to an O-shaped ring 72. The bearing 68 is square-shaped and includes a bearing hole 69 defined through its center. However, it will be appreciated that bearings of different types may be used, e.g., a ball bearing, without departing from the scope of the invention. As for the construction of the bearing assembly, the bearing plate 66 containing the bearing plate hole 67 is mounted to the first vertical column 18 so that the bearing plate hole 67 is aligned with the bore 71 of the first vertical column. Next, the bearing 68 is mounted to the bearing plate 66 by a set of four screws 70, which pass through the small screw holes 65 in the bearing plate 66. The bearing 68 is mounted to the bearing plate 66 so that the bearing hole 69 is also in alignment with the bore 71 of the first vertical column. The bearing 68 is preferably made of an ultra-high molecular weight plastic or similar anti-friction material. The bearing cover 64 containing the bearing cover hole 63 is then mounted to first vertical column 18 so that it encases the bearing 68 and the bearing plate 66. In addition, the bearing cover hole 63 is aligned with the bearing hole 69, the bearing plate hole 67 and the bore 71 of the first vertical column, as well as the ring assembly 47 mounted on the opposite side of the vertical column 18. The diameter of the bearing cover hole 63 is slightly larger than the diameter of the bearing hole, therefore, a portion of the bearing 68 surrounding the bearing hole 69 protrudes through the bearing cover hole 63 so that persons are unable to pinch fingers within the bearing assembly 46. Again, the bearing cover 64 and the bearing plate 66 are secured to the first vertical column by a pair of bolts 76 and nuts 78. It must be noted, however, that the bearing cover 64 and the bearing plate 66 of both the bearing assembly 46 and ring assembly 37 may be mounted to the first vertical column by an expansible fastening device (not shown) which is disclosed in commonly assigned U.S. Pat. No. 5,156,007, the disclosure and drawings of which are specifically incorporated herein by reference.

Once the ring assembly 47 and the bearing assembly 46 have been mounted upon the first vertical column 18, the pipe 12 and the crank 22 must be attached. The first end 14 of the pipe 12 is welded to a shaft 60. The opposite end of the shaft 60 is welded to a universal joint 62. The pipe stub is long enough so that when it and the universal joint are inserted into the bearing assembly 46, they pass through the bore 71 of the first vertical column, and the ring assembly 47. The outer diameter of the shaft is slightly smaller than the diameter of the bearing hole 69 and the O-shaped ring 72. Therefore, the shaft fits snugly therein. When fully inserted, the universal joint protrudes through the ring assembly mounted upon the opposite side of the first vertical column and is attached to the first end 24 of the crank 22. Once the shaft and universal joint are fully inserted and attached to the crank through the ring assembly 47, the pipe is supported by the bearing assembly 46, while the universal joint 62 and the first end 24 of the crank 22 are housed within the bore 71 of the first vertical column and the ring assembly 47.

Referring primarily to FIG. 1, the second end 16 of the pipe 12, it is also coupled to another bearing assembly 46 mounted to the second vertical column 22 by a shaft 60, as described above. In operation, the pipe 12 is rotated by manually turning the crank 22. The bearing assemblies 46 at either end of the pipe both support the pipe and allow the pipe to rotate freely and easily. In particular, the bearings 68 which are made of an anti-friction material and are contained within the bearing assemblies 46, substantially eliminate friction and allow the pipe 12 to rotate freely. It will be obvious to one skilled in the art that any type of bearing and/or bearing assembly that can support the pipe and allow the pipe to freely rotate may be suitably used.

As the crank 22 is manually turned during operation, the pipe 12 rotates because the crank is connected to the pipe by the universal joint 62 and the shaft 60. The universal joint provides the crank with a degree of flexibility while it is being turned. Such flexibility is necessary to ensure proper alignment of the pipe in relation to the crank. If a universal joint is not present and the crank is connected directly to the pipe by the shaft 60, rotation of the crank may cause the shaft to twist, forcing the pipe and the crank out of alignment. As a result, the crank would become increasingly difficult to turn and would eventually bind up and stop turning completely. However, it will be appreciated that various types of joints may be used to connect the pipe to the crank as long as they prohibit binding and provide the crank with a degree of flexibility. Another consequence of including the universal joint 62 is that a bearing is not necessary to facilitate free rotation of the first end 24 of the crank. In fact, a bearing would hamper free rotation because it would limit the flexibility of the universal joint. Consequently, the ring assembly 47 including the O-shaped ring 72, is used to couple the first end of the crank with the first vertical column 18 as opposed to a bearing assembly. The O-shaped ring floats relatively freely between the bearing plate 66 and the bearing cover 64 and allows the universal joint to remain flexible. In addition, the O-shaped ring fills any space between the first end of the crank and the ring assembly so that persons cannot pinch fingers and such between the crank and the bearing cover 64 of the ring assembly.

Yet another consequence of the universal joint 62 is that the crank 22 would be allowed to move relatively freely in all directions due to the flexibility of the universal joint if the second end of the crank were not braced in some way. In order to brace the crank, the second end 26 of the crank is coupled to a third vertical column 48 by another bearing assembly 46 so that the crank extends between the first vertical column 18 and the third vertical column 48. Here, the bearing assembly supports the crank and limits the movement of the crank to either a forward or backward rotation. Because the bearing 68 is made of a ultra-high molecular weight plastic or similar anti-friction material, the crank is allowed to turn freely and easily within the bearing assembly 46 mounted to the third vertical column 48. In addition, the bearing 68 on the third vertical column protrudes through the bearing cover hole 63 of the bearing cover 64, thus preventing persons from pinching themselves between the crank and the bearing assembly. It will be obvious to those skilled in the art that any type of crank that facilitates easy rotation may be used. In the preferred embodiment, the crank employed is known as a windlass.

Figure 4:
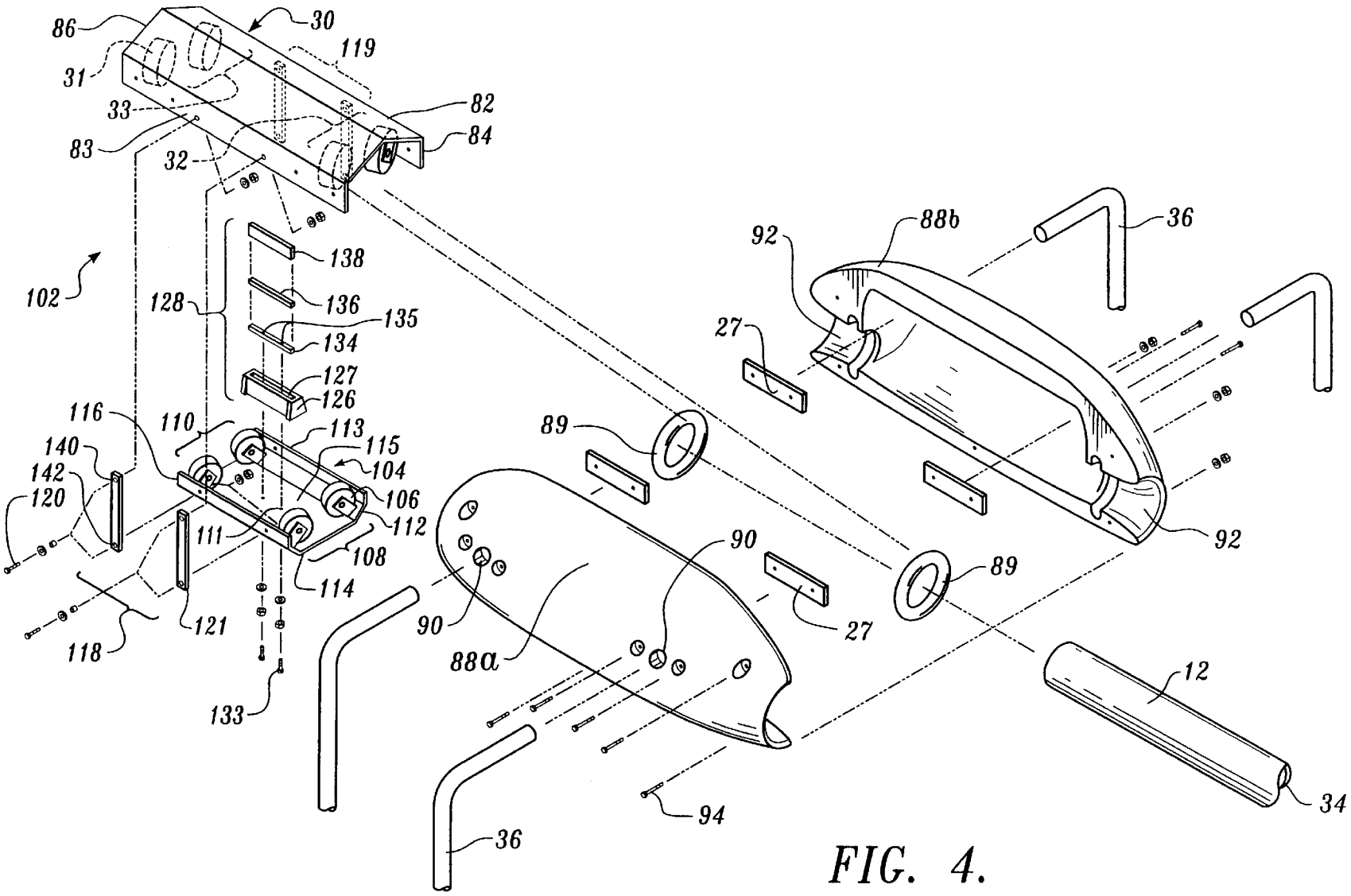
FIG. 4 is an exploded three-dimensional view of a carriage, carrier assembly, support pipe, and protective housing assembly formed in accordance with the present invention.

The playground carriage further comprises a carriage 28 for carrying people that is mounted upon the pipe 12. As the pipe is rotated, the carriage 28 advances along the longitudinal axis of the pipe. As illustrated in FIG. 4, the carriage 28 includes a carrier assembly 102 that is adapted to both advance the carriage along the pipe and bring the carriage to a stop when necessary. In a preferred embodiment, the carrier assembly 102 comprises a carrier 30 located on top of the pipe 12, a brake 104 located beneath the pipe 12 and a first pair 118 and a second pair 119 of parallel linkage arms 121 connecting the brake to the carrier assembly so that the brake is suspended beneath the pipe and below the carrier. When the brake is not employed, it is suspended in alignment with the carrier. That is, the brake 104 is suspended beneath the pipe 12 directly below the carrier 30 such that the parallel linkage arms 121 are perpendicular to the longitudinal axis of the pipe. However, as more clearly illustrated in FIG. 7, when the brake is employed, it is forced out of alignment with the pipe, and is suspended beneath the pipe such that the parallel linkage arms are at an acute angle $\psi$ with the longitudinal axis l of the pipe.

Returning to FIG. 4, the carriage 28 is propelled along the pipe 12 by the carrier 30. The carrier 30 comprises a rectangular frame 82, a pair of longitudinal sides 83, a first end 84 and an opposing second end 86. The frame 82 is preferably made of a very strong, rigid material such as galvanized steel. The carrier 30 is placed above the pipe so that the longitudinal sides 83 of the frame run parallel to the pipe. A set of carrier wheels 31 is mounted on the underside of the frame 82. The carrier wheels are preferably made of phenolic plastic or a similar hard, slippery material in order to reduce friction and increase durability. In the preferred embodiment, a first pair 32 of carrier wheels is attached to the first end 84 of the frame, while a second pair 33 of carrier wheels is attached to the second end 86 of the frame. Each carrier wheel of both the first pair 32 and the second pair 33 are mounted to the frame 82 by a flange 96. When the carrier 30 is placed upon the pipe 12, both the first pair and the second pair of carrier wheels are oriented so that the carrier wheels frictionally engage a smooth cylindrical outer surface 34 of the pipe and follow a helical or thread-like path along the pipe as it is rotated.

The brake 104 is used to bring the carriage 28 to a stop by stopping rotation of the support pipe 12. The brake comprises, in part, a rectangular brake plate 112 preferably having an upper surface 115, a first end 114, an opposing second end 116 and a pair of upturned longitudinal sides 113. The brake plate 112 is also preferably made galvanized steel or a similar strong, rigid material. A set of brake wheels 106 is mounted upon the upper surface of the brake plate 112. However, the brake wheels are preferably smaller in diameter than the carrier wheels 31. In addition, since the brake wheels will be used to stop rotation of the pipe, the brake wheels are preferably made of a material that is durable, but does not greatly reduce friction, e.g., hard rubber. In the preferred embodiment, a first pair 108 of brake wheels is attached to the longitudinal sides 113 at the first end 114 of the brake plate 112, while a second pair 110 of brake wheels is attached to the longitudinal sides at the second end 116 of the brake plate. Each brake wheel of both the first pair 108 and the second pair 112 are mounted to the longitudinal sides 113 by a flange 122. When the brake 104 is suspended beneath the pipe 12 from the carrier 30 by the set of parallel linkage arms 121, both the first pair and the second pair of brake wheels are oriented so that the brake wheels frictionally engage the smooth, cylindrical outer surface 34 of the pipe, and also follow a helical or thread-like path along the pipe as the pipe 12 is rotated.

In addition to the brake wheels 106, a wiper assembly 128 is located on the upper surface 115 of the brake plate 112 to assist in bringing the rotation of the longitudinal pipe 12 to a stop. The wiper assembly 128 is mounted in approximately the center of the upper surface of the brake plate and comprises a wedge 126 having a slot 127 defined therethrough. The slot 127 is fitted with a rubber strip 138, a backing plate 136 and an adjustment plate 134. The adjustment plate contains a pair of holes 135 and is inserted into the slot 127 so that the holes 135 of the adjustment plate are in alignment with a pair of holes 111 defined through the brake plate 112. The adjustment plate is fastened to the brake plate by a pair of bolts 133 which extend through the brake plate 112 and into the adjustment plate 134. The backing plate 136 is then inserted into the slot 127 on top of the adjustment plate 134. Finally, the rubber strip 138 is inserted into the slot 127 on top of the backing plate 136 so that a portion of the rubber strip protrudes upwardly from the slot. The portion of rubber strip protruding from the slot may be increased or decreased as desired by adjusting the bolts 133. Specifically, tightening the bolts 133 raises the adjustment plate 134, thus raising the backing plate 136 and rubber strip, while loosening the bolts 133 lowers the adjustment plate, thus lowering the rubber strip.

The brake 104 is suspended beneath the pipe 12 directly below the carrier 30 by the parallel linkage arms 121. Each arm 121 comprises a first end 140 and a second end 142. With respect to the first pair 118 of arms 121, the first end of each arm is attached by a bolt 120 to one of the longitudinal sides 113 of the carrier frame 82, while the second end of each arm is attached to the corresponding longitudinal side 113 of the brake plate 112. It will be appreciated that the other pair 119 of parallel arms is attached to the opposing longitudinal sides of the frame and the brake plate in the same manner. The length of the parallel linkage arms 121 is established such that the brake wheels 106 will make frictional contact with the outer surface 34 of the pipe 12 when the brake 104 is not employed, and the arms are perpendicular to the longitudinal axis l of the pipe. However, the arms are attached so that they are allowed to swing from a perpendicular position to an angled position. Specifically, each arm 121 forms an acute angle $\psi$ with the longitudinal axis l of the pipe when the brake is employed.

Figure 5:
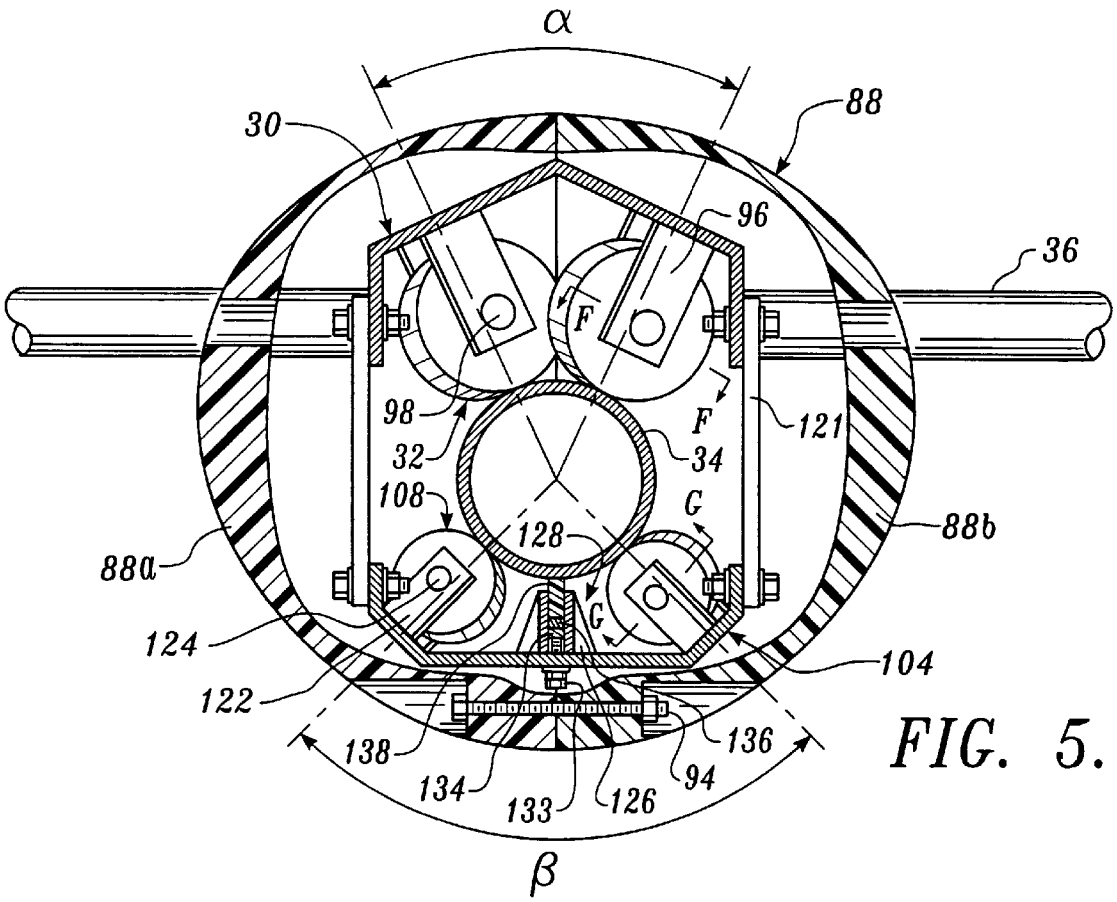
FIG. 5 is a cross-section of the carrier assembly mounted upon the support pipe of FIG. 4.

The position of the brake 104 and the carrier 30 is more clearly depicted in FIG. 5. Specifically, FIG. 5 is a cross section of the carrier assembly 102 mounted upon the support pipe 12, wherein the position of the carrier wheels 31 of the first carrier pair 32 relative to one another, the position of the brake wheels 106 of the first brake pair 108 relative to one another and the position of the wiper 128 relative to the pipe are illustrated. It will be appreciated that the second pair 33 of carrier wheels 31 and the second pair 110 of brake wheels 106 are mounted to the opposing second end 86 of the frame 82 and the opposing second end 116 of the brake plate 112, respectively, in exactly the same manner.

The flange 96 of each carrier wheel 31 of the first pair 32 is mounted to the first end 84 of the frame 82 so that the carrier wheels of the first pair are displaced in circumferential direction of the outer surface 34 of the pipe 12 through an angle $\alpha$. More specifically, the carrier wheels of the first pair must be oriented to one another at an angle $\alpha$ so that the carrier wheels maintain their frictional engagement with the outer surface of the pipe as the pipe is rotated without binding against the pipe. Preferably, the carrier wheels of the first pair are oriented at a 50° angle to one another in order to maintain stability of the carrier wheels as they follow their helical path along the pipe. By mounting the carrier wheels of both the first pair 32 and the second pair 33 in the manner shown in FIG. 5, the frame 82 is properly supported on the pipe between the frame's first end 84 and its second end 86 and stably moves along the pipe.

As for the brake 104, the flange 122 of each brake wheel 106 of the first pair 108 is mounted at the first end 114 of the brake plate 112 so that the brake wheels of the first pair are displaced in circumferential direction of the outer surface 34 of the pipe 12 through an angle $\beta$ that is larger than the angle $\alpha$ at which the first pair of carrier wheels 31 are displaced. Specifically, the brake wheels of the first pair are preferably oriented at a 90° angle to one another so that the brake wheels bind against the pipe when the brake is employed. However, when the brake 104 is not employed, the brake wheels merely maintain their frictional engagement with the outer surface 34 so that the carriage assembly 30 is properly mounted upon the support pipe and the brake wheels 106 do not bind against the support pipe. In this case, the brake 104 remains aligned with the carrier and the entire carrier assembly 102 stably moves along the pipe.

Figure 6A:
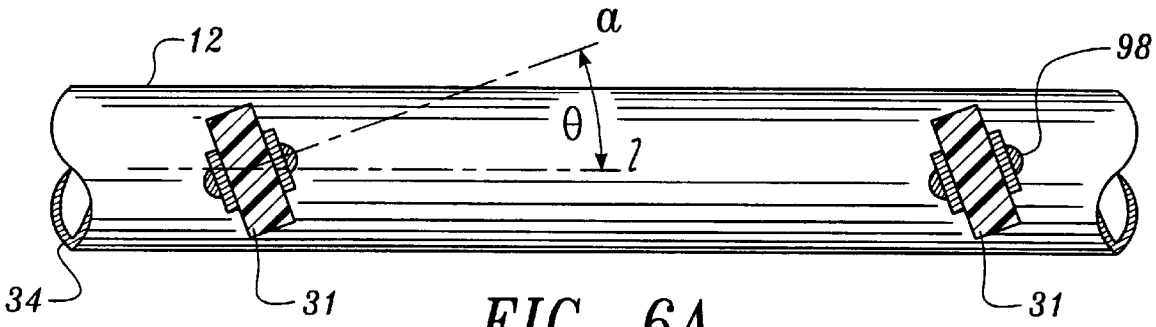
FIG. 6A is a cross-sectional view of the carrier assembly and support pipe along the line F—F of FIG. 5.
Figure 6B:
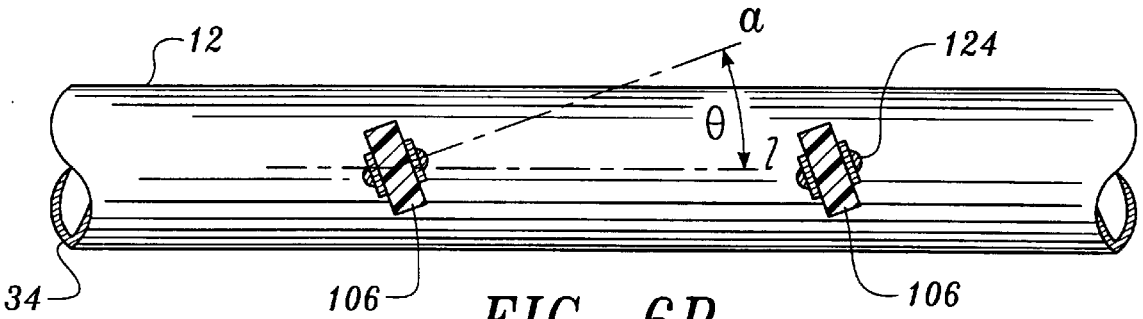
FIG. 6B is a cross-sectional view of the carrier assembly and support pipe along the line G—G of FIG. 5.

Although the brake wheels 106 of each brake pair 108 and 110 are oriented to one another at an angle larger than the carrier wheels 31 of each carrier pair 32 and 33, the carrier wheels 31 and the brake wheels 106 must be oriented at the same "pitch" with respect to the longitudinal axis l of the pipe 12. Specifically, FIG. 6A is a cross-sectional view of the carrier along the line F—F of FIG. 5. If an axis a is drawn through an axle 98 of the carrier wheel 31, this axis a would be inclined through an acute angle $\Theta$ with respect to the longitudinal axis l of the pipe. This angle $\Theta$ is known as the "pitch." The axles of all four wheels of the carrier 30 should be inclined at the same acute angle $\Theta$ with respect to the longitudinal axis of the pipe. Accordingly, FIG. 6B is a cross-sectional view of the brake 104 along the line G—G of FIG. 5. As illustrated, the axle 124 of all four of the brake wheels 106 are inclined at the same acute angle $\Theta$ with respect to the longitudinal axis l of the pipe 12. Hence, when the brake 104 is not employed, the carrier assembly 102, together with the carriage 28, is propelled along the longitudinal axis l of the support pipe at a rate of $\pi dn\ (\Theta)$ inches per second; where d is a diameter of the support pipe in inches, n is a number of revolutions of the pipe per second, and Θ is the pitch of the carrier and brake wheels relative to the longitudinal axis of the pipe. It is obvious that if the number of rotations per second is increased or if the pitch is increased, the speed of the movement of the carriage 28 in the longitudinal direction of the pipe will likewise be increased. It will also be obvious that if the direction of rotation of the pipe is reversed, the direction of movement of the carriage along the pipe will also be reversed. It is also obvious that regardless of the direction of rotation of the pipe, all of the carrier wheels 31 and all of the brake wheels 106 will follow the same helical, thread-like path along the pipe as the pipe is rotated. Finally, it is obvious that if the pitch of the brake wheels 106 differs from that of the carrier wheels, the carrier assembly 102 will be unable to move along the pipe.

The position of the wiper assembly 128 relative to the support pipe 12 is also depicted in FIG. 5. As described above, when the brake 104 is not employed, the brake 104 is suspended beneath the pipe directly below the carrier. In this position, the rubber strip 138 of the wiper assembly 128 does not frictionally engage the pipe. However, it will be appreciated that when the brake 104 is employed, the rubber strip 138 makes contact with the pipe, thereby producing enough friction to slow the rotation of the pipe. It is apparent that over time, the rubber strip 138 will begin to wear. Consequently, it may become necessary to adjust the rubber strip as described in more detail above.

Figure 7:
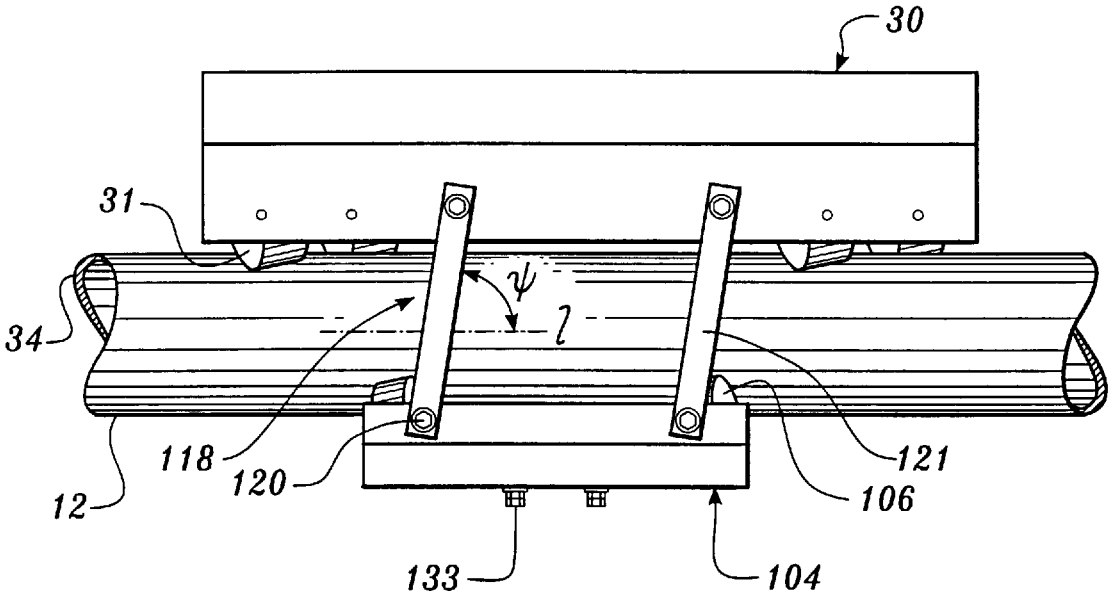
FIG. 7 is a side view of the carrier assembly and the support pipe.

FIG. 7 is an unobstructed side view of the carrier assembly 102 when the brake 104 is employed (the housing 88 and handrails 36 have been omitted from this view). During operation, it is necessary to employ the brake and prevent users from pushing the carriage along the support pipe 12 because such action can cause the pipe to rotate too rapidly. If the pipe is allowed to rotate too rapidly, the crank 22 will spin at unsafe speeds and the heavy fast-moving carriage 28 will pose a safety threat. In the preferred embodiment of the present invention, the carriage is prevented from being pushed by employing the brake 104, i.e., by forcing the carrier 30 out of alignment with the brake 104.

More specifically, when an outside force is exerted on the carriage 28, the carrier 39 accelerates, while the velocity of the brake 104 remains the same. Consequently, the slower moving brake 104 begins to lag behind the accelerating carrier 30. In turn, each pair 113 of parallel arms 121 swings from a perpendicular position to an angled position, causing the brake 104 to be pulled upwardly, toward the support pipe 12. Thus, the brake 104 exerts an increasing upward normal force against the pipe. Correspondingly, the parallel arms 121 pull the carrier 30 downwardly so that the carrier exerts an increasing downward normal force against the pipe and the carrier wheels 31 are forced out of their helical path. In addition, since the brake wheels 106 of each pair 108 and 110 of the brake 104 are oriented to one another at a significantly wide angle, the brake wheels remain on their helical path but begin to bind against the pipe. Finally, as the brake 104 is pulled toward the pipe, the rubber strip 138 of the wiper assembly 128 comes into frictional contact with the longitudinal pipe causing rotation of the pipe to slow. The cumulative result is that the carrier 30 and the brake 104 collapse against the pipe 12, causing the pipe to cease rotating. To resume the linear progression of the carriage 28, one merely waits for the carrier assembly 102 to resume its aligned position. More specifically, after the carriage 28 stops, each set of parallel arms 121 swings back to a perpendicular position with respect to the support pipe 12, bringing the brake 104 back to its aligned position directly beneath the carrier assembly 102. Linear progression of the carriage 28 then resumes by manually operating the crank 22 and rotating the pipe 12.

Figure 8:
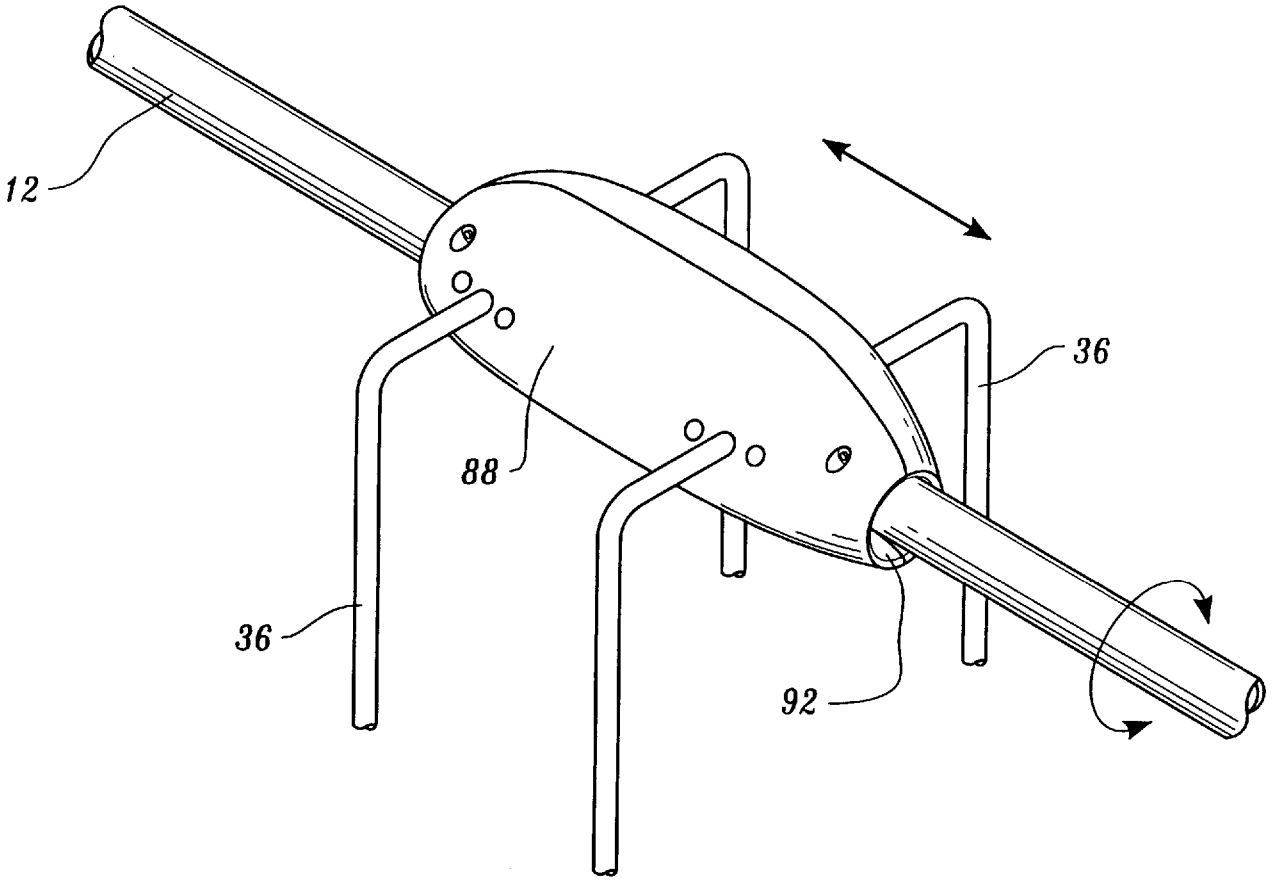
FIG. 8 is a three-dimensional view of the structure illustrated in FIG. 4 once assembled.

Referring now to FIGS. 1, 4 and 8, the carriage 28 further comprises a plurality of handrails 36 which extend downwardly from the carrier assembly 28 and are attached to a platform 37 so that the platform is suspended below the carrier assembly. The handrails and the platform are designed to support a number of persons mounted upon the carriage 30. In addition, the carrier assembly 102 including the carrier 30 and the brake 104 is encapsulated by a protective housing 88. The housing 88 is preferably made of a strong resilient material such as plastic that can withstand exposure to the natural elements of the outdoors and the constant use by people. The housing encapsulates the assembly 102 so as to protect persons from accessing the carrier or brake and injuring themselves. In addition, the housing provides a person with a saddle so that he or she can ride on top of the carriage 28. In the preferred embodiment, the housing comprises two halves 88*a* and 88*b* which are bolted together around the carriage 30 and the pipe 12 by a bolt 94. The housing contains a number of small bores 90 through which the handrails 36 may pass so that a plate 27 attached to the upper end of each handrail may be bolted upon the frame 82 of the carrier 30. In addition, the housing, when joined, forms a circular opening 92 on either end that allows the pipe 12 to pass through the housing. A large protective ring 89 is mounted adjacent to the large circular openings 92 on either end of the housing so that the ring surrounds the pipe as it passes through the housing. The large protective ring is preferably made of an ultra-high molecular weight plastic or similar anti-friction material so that the plastic housing freely slides along the support pipe as the carriage 28 moves along the pipe. In addition, the protective ring 89 prevents persons from reaching into the housing and injuring themselves. Consequently, a person can safely climb upon the housing without fear of injury. It will be readily apparent to those skilled in the art that the housing may be of any configuration or construction suitable to prevent persons from accessing the carrier 30 or to facilitate a person's use of the carriage 28.

Figure 9:
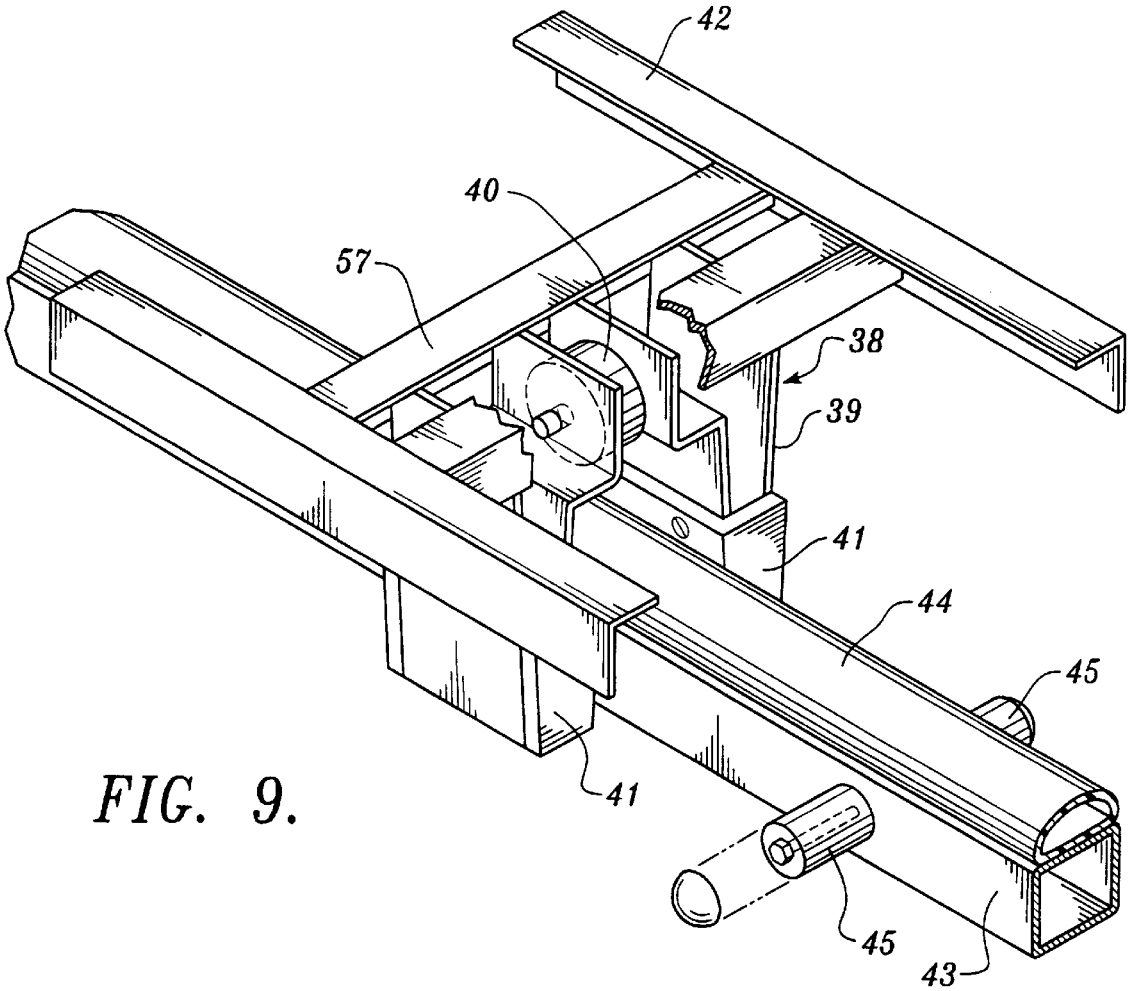
FIG. 9 is a top view of a guide attached to a platform in accordance with the present invention.
Figure 10:
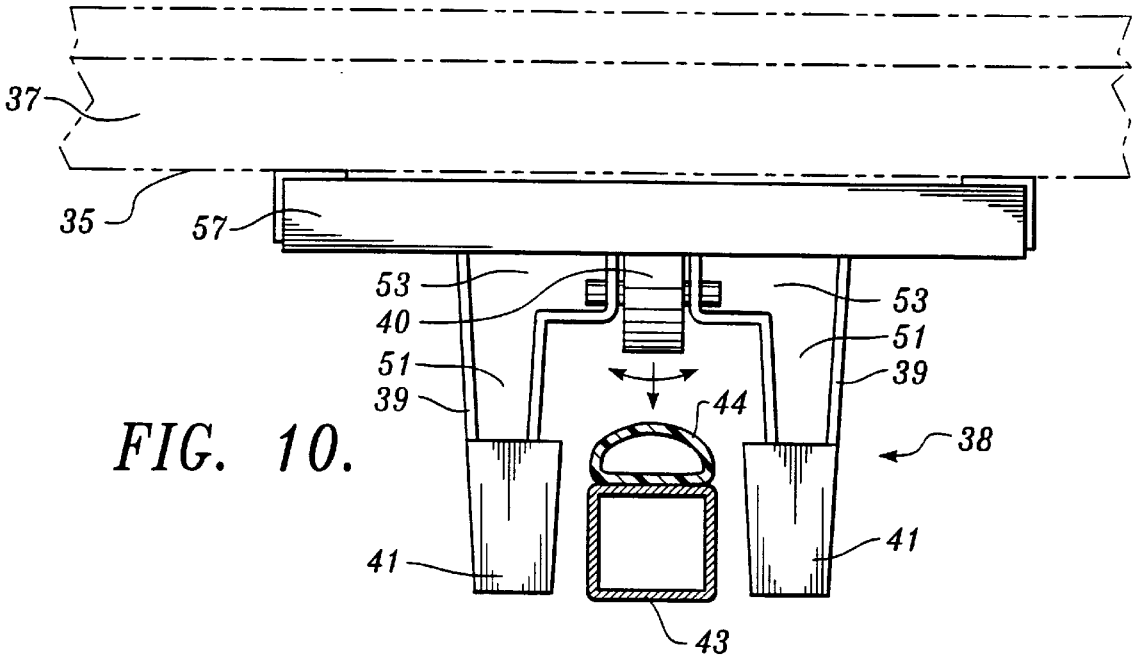
FIG. 10 is a front view of the guide attached to the platform of FIG. 9.

Referring to FIGS. 9 and 10, the playground carriage 10 further comprises a guide rail 43 adapted to guide the carriage 28 as it moves along the pipe 12. The guide rail is located immediately below the platform 37 of the carriage 28 and extends between the first vertical column 18 and the second vertical column 20. A bumper 44 is attached to the upper surface of the guide rail 43. The bumper protects users from striking the guide rail and injuring themselves. The bumper is preferably made of a flexible and resilient material such as rubber or plastic.

To further increase the stability of the carriage, a guide 38 is attached to a lower surface 35 of the platform 37. The guide 38 engages the guide rail 43 and prevents the carriage 30 from swinging excessively from side-to-side as the carriage moves along the pipe 12. The guide comprises a pair of substantially L-shaped flanges 39 coupled to a substantially H-shaped frame 42. The H-shaped frame is mounted to the lower surface of the platform directly above the guide rail. The flanges and the H-shaped frame are preferably made of a very strong rigid material such as galvanized steel. Each flange 39 includes a substantially vertical leg 51 and a substantially horizontal base 53. The base 53 of each flange is coupled to a cross-bar 57 of the H-shaped frame so that the flanges oppose each other and the legs 51 extend downwardly from the lower surface of the platform. In addition, the flanges are mounted to the underside of the cross-bar 57 a small distance apart, leaving a gap between the bases. A wheel 40 is housed within the gap between the bases and is supported by the respective bases. The wheel 40 is preferably made of urethane plastic or similar friction-reducing, durable material. Finally, the guide 38 comprises an anti-friction sleeve 41 which covers the lower portion of the leg 51 of each flange. The anti-friction sleeve is preferably made of an ultra-high molecular weight plastic or similar anti-friction material.

In operation, the guide rail 43 passes between the flanges 39 of the guide 38. If the carriage 28 begins to swing transversely relative to the pipe 12, the flange will make contact with the guide rail and prevent the carriage from swinging any farther. However, the longitudinal progress of the carriage will not be stopped because the anti-friction sleeve 41 will allow the flange to slide along the guide rail. Hence, the friction caused by the flange striking the guide rail will prevent the carriage from swinging transversely to a great degree, but will not prevent the carriage from continuing its movement longitudinally along the pipe.

Another potential impediment to the longitudinal progress of the carriage is overloading the carriage with an abnormally large group of people so that the carriage bumps along the guide rail as the carriage moves along the pipe 12. When this occurs, the wheel 41 is forced into contact with the bumper 44 momentarily. The carriage continues its longitudinal progress, however, because the wheel 41 rolls on top of the bumper and along the guide rail. The bumper will give slightly beneath the wheel due to the weight of the carriage. To support the guide rail as the carriage bumps and swings against the guide rail, a vertical support post 15 is mounted to the underside of the guide rail at either end of the guide rail.

In addition to the bumper 44 and the support posts 15, a stop 45 is attached to the guide rail 43 adjacent to the first vertical column 18, and adjacent to the second vertical column 20. The stop protrudes from both sides of the guide rail. As the carriage 28 reaches the first or second vertical column, the guide 38 will come into contact with the stop 45, forcing the carriage to a halt. Hence, the carriage will not ram into the first or second vertical column and cause injury to the user or damage to the carriage. It will be obvious to one skilled in the art that stops of various configurations could adequately serve this purpose. Occasionally, when the guide forcibly makes contact with the stop 21, the carriage 28 will bounce backward along the pipe. When this occurs, the carrier 30 of the carrier assembly 102 is forced out of alignment with the brake 104 and the carriage 28 is forced to a halt as described above.

Finally, referring to FIG. 1, a preferred embodiment of a playground carriage 10 further includes a receiving deck 50 located adjacent to the second vertical column 20. Therefore, those persons transported by the carrier 28 may dismount the carrier and step directly upon the receiving deck 50. In addition, the preferred embodiment of the playground carriage 10 includes a cranking deck 52 located adjacent to the first vertical column 18, so that the person manually turning the crank 22 may stand upon the cranking deck 52. It will be readily apparent to those skilled in the art that any structures providing an area upon which persons may dismount or stand, may suitably be used.

While a number of the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An apparatus for use in playground and recreational environments, the apparatus comprising:

(a) first and second upright support structures;

(b) a support pipe rotatable along the pipe's longitudinal axis having first and second ends, the first end of the support pipe braced by the first upright support structure, and the second end of the support pipe braced by the second upright support structure, wherein the support pipe extends between the first and the second upright support structures;

(c) a manually-operated crank having a first end and a second end, wherein the first end of the crank is operatively connected to the first end of the support pipe so that manually turning the crank rotates the support pipe;

(d) a carriage linked to the support pipe, the carriage configured to be capable of moving objects along the longitudinal axis of the support pipe as the support pipe rotates;

(e) a carrier assembly operatively associated with the carriage and including a carrier having a set of carrier wheels oriented along the outer surface of the pipe so that the set of carrier wheels follow a helical, thread-like path along the pipe and advance the carriage along the longitudinal axis of the pipe as the pipe is rotated; and (f) a brake depending from the carrier by at least two arms, the brake including a set of brake wheels oriented along the outer surface of the pipe such that the set of brake wheels follow a helical, thread-like path along the pipe when the brake is aligned with the carrier, and bind against the pipe when the brake is not aligned with the carrier.

2. The apparatus of claim 1, wherein the support pipe has a smooth cylinderical outer surface.

3. The apparatus of claim 1, the carriage further comprising:

(a) a handrail extending downwardly from the carrier assembly;

(b) a platform attached to the handrail and adapted to downwardly depend from the carrier assembly; and (c) a protective housing encapsulating the carrier assembly.

4. The apparatus of claim 1, further comprising a cranking deck adjacent to the first upright support structure, whereby people manually turning the crank may position themselves.

5. The apparatus of claim 1, the arms being substantially perpendicular to the longitudinal axis of the support pipe when the brake is aligned with the carrier, and the arms being at an acute angle to the support pipe when the brake is not aligned with the carrier.

6. The apparatus of claim 1, wherein the carrier further comprises a substantially rectangular frame having a first end and an opposing second end, wherein the frame is mounted above and parallel to the pipe.

7. The apparatus of claim 6, wherein the set of carrier wheels comprise a first pair of carrier wheels attached to the first end of the frame and a second pair of carrier wheels attached to the second end of the frames the first pair and the second pair of carrier wheels frictionally engaging the pipe.

8. The apparatus of claim 7, wherein the carrier wheels of the first pair are oriented at a first predetermined angle to one another, and wherein the carrier wheels of the second pair are oriented at the first predetermined angle to one another.

9. The apparatus of claim 7, wherein the carrier wheels of both the first pair and the second pair are oriented at approximately the same pitch relative to the longitudinal axis of the pipe, so that the carrier wheels of both the first pair and the second pair follow a helical, thread-like path along the pipe as the pipe is rotated.

10. The apparatus of claim 1, wherein the brake further comprises a substantially rectangular plate having a first end, an opposing second end, and a pair of longitudinal sides, and wherein the plate is suspended beneath the pipe and the carrier member and secured to align the longitudinal sides of the plate in parallel with the pipe.

11. The apparatus of claim 10, wherein the set of brake wheels comprises a first pair of brake wheels attached to the first end of the plate and a second pair of brake wheels attached to the second end of the plate, the first pair and the second pair of brake wheels frictionally engaging the pipe when the brake is not aligned with the carrier.

12. The apparatus of claim 11, wherein the brake wheels of the first pair are oriented to one another at a second predetermined angle, wherein the brake wheels of the second pair are oriented at the second predetermined angle to one another, and the set of carrier wheels define a first and second pair of carrier wheels that frictionally engage the pipe, the carrier wheels of the first pair oriented at a first predetermined angle to one another the carrier wheels of the second pair oriented at the first predetermined angle to one another, and wherein the second predetermined angle of the brake wheels is greater than the first predetermined angle of the carrier wheels.

13. The apparatus of claim 11, wherein the brake wheels of both the first pair and the second pair are oriented at approximately the same pitch as the carrier wheels relative to the longitudinal axis of the pipe, so that the brake wheels of both the first pair and the second pair follow a helical, thread-like path along the pipe as the pipe is rotated.

14. The apparatus of claim 10, wherein the brake further comprises a wiper including an adjustable strip, the wiper being adjustably secured to the brake plate and selectively engagably with the pipe, such that the strip does not frictionally engage the pipe when the brake is aligned with the carrier, and such that the strip does frictionally engage the pipe when the brake is not aligned with the carrier.

15. The apparatus of claim 3, further comprising a guide rail adapted to direct the carriage, wherein the guide rail is positioned below the platform of the carriage and extends parallel to the support pipe between the first and the second upright support structures.

16. The apparatus of claim 15, wherein the carriage further comprises a guide attached to a lower surface of the platform, wherein the guide intermittently engages the guide rail and is positioned to dampen excessive swinging motion of the carriage as it moves along the pipe.

17. The apparatus of claim 16, wherein the guide houses a wheel that rollably engages the guide rail when the carriage is occasionally forced into contact with the guide rail.

18. The apparatus of claim 15, wherein the guide rail further comprises a first stop located adjacent to the first upright support structure, and a second stop located adjacent to the second upright support structure.

19. The apparatus of claim 1, further comprising a plurality of handrails extending downwardly from the carriage.

20. The apparatus of claim 1, further comprising a third upright support structure, wherein the second end of the crank is rotatable attached to the third upright support structure, so that the crank extends between the first and the third upright support structures.

21. The apparatus of claim 1, further comprising a receiving deck adjacent to the second upright support structure, whereby people transported by the carriage may dismount.

22. An apparatus for use in playground and recreational environments, the apparatus comprising:

(a) first and second upright support structures;

(b) a longitudinally rotatable support pipe having a first end attached to the first upright support structure and having a second end attached to the second upright support structure, wherein the support pipe extends longitudinally between the first and second upright support structures;

(c) a cranking member operatively associated with the first end of the support pipe, wherein the support pipe is rotated by manually turning the cranking member;

(d) a carrying member linked to the support pipe and configured to be capable of moving objects along the support pipe as the pipe is rotated;

(e) a guiding member configured to dampen excessive swinging of the carrying member as the carrying member moves along the pipe as the pipe is rotated;

(f) a carrier assembly operatively associated with the carrying member and including a carrier having a set of carrier wheels mounted beneath the carrier and adjacent to the pipe, wherein the set of carrier wheels is oriented along a smooth cylindrical outer surface of the pipe so that the carrier wheels frictionally engage the outer surface of the pipe and follow a helical, thread-like path along the pipe, thus propelling the carrying member along the pipe as the pipe is rotated, (g) a brake including a set of brake wheels oriented along the outer surface of the pipe so that the brake wheels frictionally engage the outer surface of the pipe and follow the helical, thread-like path along the pipe when the brake is aligned with the carrier, and bind against the pipe when the brake is not aligned with the carrier; and (h) a plurality of arms connecting the carrier to the brake such that the brake is suspended beneath the pipe below the carrier.

23. The apparatus of claim 22, further comprising a receiving deck adjacent to the second upright support structure, whereby people transported by the carrying member may dismount.

24. The apparatus of claim 22, wherein the guiding member includes a guide attached to a lower surface of the platform, wherein the guide engages a guide rail that is located below the carrying member and that extends parallel to the pipe between the first upright support structure and the second upright support structure.

25. The apparatus of claim 24, wherein the guiding member further comprises a wheel housed within the guide that rollably engages the guide rail when the carrying member is occasionally forced downwardly towards the guide rail.

26. The apparatus of claim 24, wherein the guide rail further comprises a first stop located adjacent to the first upright support structure, and a second stop located adjacent to the second upright support structure.

27. The apparatus of claim 22, wherein the carrying member comprises a handrail extending downwardly from the carrying member, a platform attached to the handrail suspended below the carrying member, and a protective housing that encapsulates the carrier assembly.

28. The apparatus of claim 22, further comprising a cranking deck adjacent to the first upright support structure, whereby people manually turning the, cranking member may be positioned.

29. The apparatus of claim 22, wherein the arms are substantially perpendicular to a longitudinal axis of the support pipe when the brake is aligned with the carrier, and the arms are at an acute angle to the longitudinal axis of the support pipe when the brake is not aligned with the carrier.

30. The apparatus of claim 22, wherein the set of carrier wheels includes a first pair of carrier wheels and a second pair of carrier wheels mounted at opposite ends of the carrier, and wherein the set of brake wheels includes a first pair of brake wheels and a second pair of brake wheels mounted at opposite ends of the brake.

31. The apparatus of claim 30, wherein the carrier wheels of the first pair are oriented at a predetermined angle to one another and the carrier wheels of the second pair are oriented at approximately the same predetermined angle to one another, and wherein the brake wheels of the first pair are oriented to one another at a larger predetermined angle than the carrier wheels and the brake wheels of the second pair are also oriented to one another at approximately the same larger predetermined angle.

32. The apparatus of claim 30, wherein both the first pair and second pair of carrier wheels, and the first pair and second pair of brake wheels are oriented at approximately the same pitch relative to the longitudinal axis of the pipe so that the first pair and second pair of carrier wheels and the first pair and second pair of brake wheels follow a helical, thread-like path along the pipe as the pipe is rotated.

33. The apparatus of claim 22, the brake further comprising a wiper having an adjustable strip adapted to frictionally engage the support pipe when the brake is not aligned with the carrier.

34. The apparatus of claim 22, further comprising a plurality of handrails extending downwardly from the carrying member.

35. The apparatus of claim 22, further comprising a third upright support structure, wherein the cranking member extends between the first and the third upright support structure.

36. An apparatus for use in playground and recreational environments, the apparatus comprising:

(a) first and second upright support structures;

(b) a support pipe rotatable along the pipe's longitudinal axis having first and second ends and an outer surface, the first end of the support pipe braced by the first upright support structure, and the second end of the support pipe braced by the second upright support structure, wherein the support pipe extends between the first and the second upright support structures;

(c) a manually-operated crank having a first end and a second end, wherein the first end of the crank is operatively connected to the first end of the support pipe so that manually turning the crank rotates the support pipe;

(d) a carriage linked to the support pipe, the carriage configured to be capable of moving objects along the longitudinal axis of the support pipe as the support pipe rotates; and (e) a brake operatively associated with the carriage, the brake depending from a plurality of arms connected to the carriage.

37. The apparatus of claim 36, wherein the carriage further comprises:

(a) a carrier assembly adapted to advance the carriage along the pipe;

(b) a handrail extending downwardly from the carrier assembly;

(c) a platform attached to the handrail and adapted to downwardly depend from the carrier assembly; and (d) a protective housing encapsulating the carrier assembly.

38. The apparatus of claim 37, the carrier assembly further comprising a carrier including a set of carrier wheels oriented along the outer surface of the pipe such that the set of carrier wheels follows a helical, thread-like path along the pipe and advance the carriage along the longitudinal axis of the pipe as the pipe is rotated.

39. The apparatus of claim 38, wherein said brake depends from the carrier by said plurality of arms, the brake including a set of brake wheels oriented along the outer surface of the pipe such that the set of brake wheels follow a helical, thread-like path along the pipe when the brake is aligned with the carrier, and bind against the pipe when the brake is not aligned with the carrier.

40. The apparatus of claim 36, wherein the arms are substantially perpendicular to a longitudinal axis of the support pipe when the brake is aligned with the carrier, and the arms are at an acute angle to the longitudinal axis of the support pipe when the brake is not aligned with the carrier.

41. The apparatus of claim 39, wherein the set of carrier wheels includes a first pair of carrier wheels and a second pair of carrier wheels mounted at opposite ends of the carrier, and wherein the set of brake wheels includes a first pair of brake wheels and a second pair of brake wheels mounted at opposite ends of the brake.

42. The apparatus of claim 41, wherein the carrier wheels of the first pair are oriented at a predetermined angle to one another and the carrier wheels of the second pair are oriented at approximately the same predetermined angle to one another, and wherein the brake wheels of the first pair are oriented to one another at a larger predetermined angle than the carrier wheels and the brake wheels of the second pair are also oriented to one another at approximately the same larger predetermined angle.

43. The apparatus of claim 41, wherein both the first pair and second pair of carrier wheels, and the first pair and second pair of brake wheels are oriented at approximately the same pitch relative to the longitudinal axis of the pipe so that the first pair and second pair of carrier wheels and the first and second pair of brake wheels follow a helical, thread-like path along the pipe as the pipe is rotated.

44. The apparatus of claim 36, the brake further comprising a wiper having an adjustable strip adapted to frictionally engage the support pipe when the brake is not aligned with the carrier.

45. The apparatus of claim 37, further comprising a guide rail adapted to direct the carriage, wherein the guide rail is positioned below the platform of the carriage and extends parallel to the support pipe between the first and the second upright support structures.

46. The apparatus of claim 45, wherein the carriage further comprises a guide attached to a lower surface of the platform, wherein the guide intermittently engages the guide rail and is positioned to dampen excessive swinging motion of the carriage as it moves along the pipe.

* * * * *

UNITED STATES PATENT AND TRADEMARK OFFICE

CERTIFICATE OF CORRECTION

PATENT NO. : 5,816,167
DATED : October 6, 1998
INVENTOR(S) : P. Danforth et al.

It is certified that error appears in the above-indentified patent and that said Letters Patent is hereby corrected as shown below:

| COLUMN | LINE | |
|---|---|---|
| 12 (Claim 7, | 60 line 4) | "frames" should read --frame,-- |
| 13 (Claim 12, | 22 line 8) | after "another" insert --,-- |
| 13 (Claim 20, | 62 line 3) | "rotatable" should read --rotatably-- |
| 14 (Claim 28, | 64 line 3) | "the," should read --the-- |

Signed and Sealed this

Twenty-third Day of March, 1999

*Attest:*

Q. TODD DICKINSON

*Attesting Officer*

*Acting Commissioner of Patents and Trademarks*